United States Patent [19]

Schatton et al.

[11] 4,319,970

[45] Mar. 16, 1982

[54] METHOD AND APPARATUS FOR ELECTROLYTIC SEPARATION OF METALS, PARTICULARLY COPPER

[75] Inventors: Helmut Schatton; Walter Krickau, both of Lünen, Fed. Rep. of Germany

[73] Assignee: Hüttenwerke Kayser Aktiengesellschaft, Fed. Rep. of Germany

[21] Appl. No.: 134,090

[22] Filed: Mar. 26, 1980

[30] Foreign Application Priority Data

Mar. 29, 1979 [DE] Fed. Rep. of Germany ..... 2912524

[51] Int. Cl.[3] ..... C25C 1/12; C25C 7/00; C25C 7/02

[52] U.S. Cl. ..... 204/106; 204/286; 204/288

[58] Field of Search ..... 204/281, 286, 288, 105 R, 204/106–108

[56] References Cited

U.S. PATENT DOCUMENTS

| | | | |
|---|---|---|---|
| 411,042 | 9/1889 | Kolle | 204/DIG. 1 |
| 553,464 | 1/1896 | Hermite | 204/286 |
| 745,412 | 12/1903 | Blackman | 204/286 |
| 799,061 | 9/1905 | Kellner | 204/286 |
| 1,209,710 | 12/1916 | Huth | 204/286 |
| 1,313,246 | 8/1919 | Antisell | 204/288 |
| 1,609,771 | 12/1926 | Poland | 204/281 |
| 2,536,877 | 1/1951 | Emanuel et al. | 204/281 |
| 3,402,117 | 9/1968 | Evans | 204/288 |
| 3,804,724 | 4/1974 | Bolger et al. | 204/281 |
| 4,102,769 | 7/1978 | Seyl | 204/286 |

OTHER PUBLICATIONS

"Hard Cr. Plating" by Greenwood, 1971, Robert Dryer Ltd., pp. 102–103.

"Trans. Electrochem. Soc.", C. T. Thomas, vol. 80 (1941), p. 504.

*Primary Examiner*—R. L. Andrews

*Attorney, Agent, or Firm*—Hill, Van Santen, Steadman, Chiara & Simpson

[57] ABSTRACT

Method and apparatus for electrolytically separating metals utilizing cathode sheets and anode sheets mounted in an electrolyte, the distance between the sheets being regulated, and may be variable as separation proceeds. The invention is also directed to an anode-cathode spacing device including improved electrically insulating spacing elements.

14 Claims, 7 Drawing Figures

FIG. 1
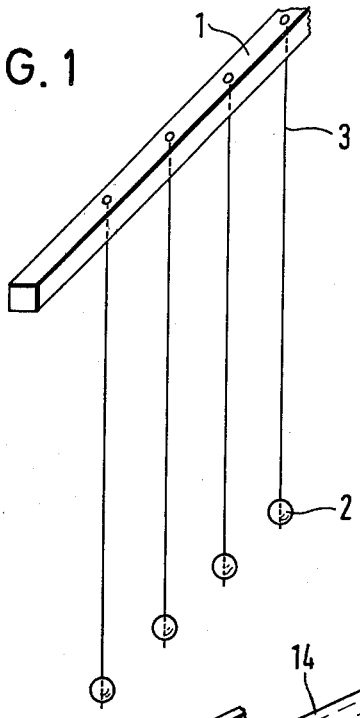
FIG. 2
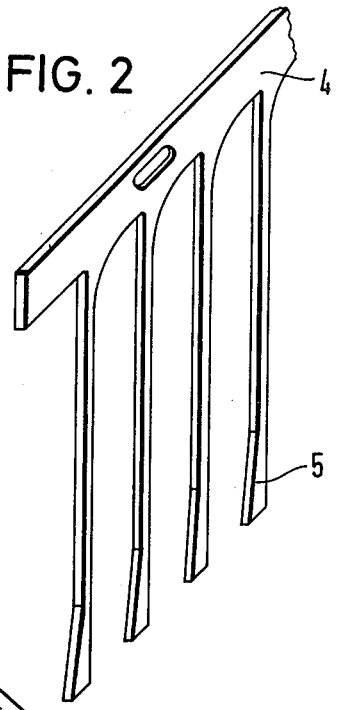
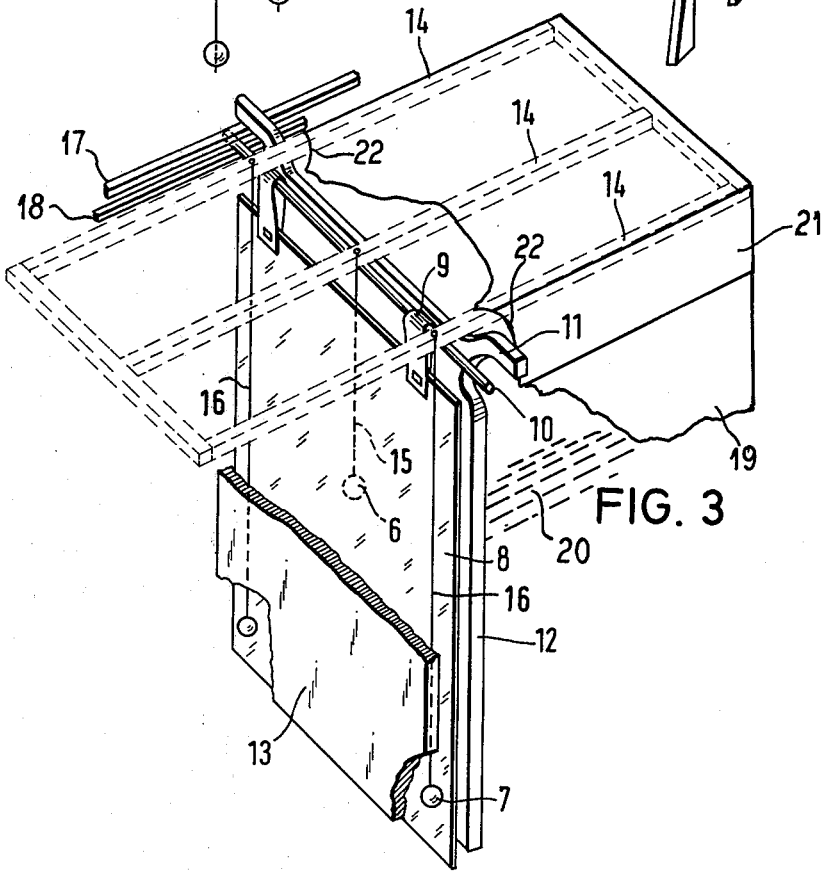
FIG. 3

METHOD AND APPARATUS FOR ELECTROLYTIC SEPARATION OF METALS, PARTICULARLY COPPER

BACKGROUND OF THE INVENTION

1. Field of the Invention

The present invention relates to a method and to an apparatus for the electrolytic separation of metals, particularly copper, in which at the beginning of the electrolytic separation, cathode sheets or plates, particularly thin starting cathode plates, are inserted between anodes in an electrolyte bath.

2. Description of the Prior Art

Upon the electrolytic refinement and recovery of metals, particularly of copper, a large number of anodes and cathodes are introduced into electrolytic baths in the form of plates or sheets, so that the metal on the cathode sheets or plates can be separated off. In order to increase the separation output, the anodes and cathodes are arranged as closely as possible to one another. As known, because of the slight spacings between anodes and cathodes, from time to time, short circuits are caused between the anodes and cathodes, which short circuits permit the current output to drop and the separation yield to diminish.

In order to prevent short circuits, it is known, for example, from the German published specification No. 25 08 094 to guide the cathode sheets at their edges in mountings of nonmetallic material. The expense of this technique is, however, considerable. In addition, the edge zones, which are necessarily covered, do not take part in the separation process.

SUMMARY OF THE INVENTION

It is the object of the present invention to provide a method of electrolytic separation and an apparatus for carrying out said separation, which appreciably decreases the expense necessary with known mountings, and which permits the utilization of the entire cathode area, and, in this, is suitable for thin cathode plates which are, for example, obtained, and in that thereby a thin layer on a starting sheet likewise electrolytically separated off, which was subsequently drawn off of the starting sheet, is utilized as a cathode sheet. For this purpose, the volume—time output and the current output—is determined to be increased as well as the utilization of energy diminished.

The object set forth above is realized in that the cathode sheets are spatially fixed in the electrolyte. By means of the spatial fixation, in contrast to the known line fixation through clamping of the edges, it is attained that also a thin cathode can carry out no movement which would have as a result, an abutting of the parts of the cathode on the anode. In this manner, the realiability of the electrolysis method is so appreciably increased, that upon a continuous supervision of the electrolysis operation, short circuits can be obviated. The current output increases, and the anode residual volume decreases.

In a development of the invention, it is provided that the elements are spaced by means of a determination of individual points or small areas of the cathode surfaces. It is hereby advantageously attained that the expense, compared with a complete spatial fixation, for example, by means of a grid, may be appreciably lowered. Surprisingly, it was found in this connection that the number of fixation points or areas may be very small, without the desired effect of the sufficient spacing being lost.

In a further development of the method, it is provided that the separation of the cathode sheet takes place by means of an indirect support of the cathode sheet on the anodes. Through this construction, advantageously a rigid system in the horizontal direction for the fixation may be obviated, as the support in the direction of strain, that is, perpendicularly to the cathode surface, may be carried out by the stable anodes. There must still take place only a vertical determination of the fastening points between the anodes and cathodes. A lateral fixation of the cathode sheets is superfluous.

In a further development of the method, it is provided that the fixation points or areas are distributed unequally on the two surfaces of the cathode sheets. Advantageously, the number of fixation points may be further decreased. The unequal distribution is possible in that it was surprisingly found that the tendency of the cathode sheets to buckle or to move, with all cathode sheets which were produced according to the same method of production, is the same. This is particularly the case if in order to save expense, an accurate alignment operation according to the production of the cathode sheets is refrained, the latter accordingly being left as far as possible in a raw condition.

It is furthermore provided that the fixation points or areas on the individual cathode sheet sides are distributed asymmetrically. Advantageously, hereby, the fact is taken into account that the cathode sheets are always satisfactorily fastened on their upper side through lug-type bands on holding rods with respect to the anodes. It is sufficient, for example, if the side of the cathode sheet with an inclination to buckle is provided with one to three bearing places in the central area and the oppositely disposed side is provided approximately on the lower edge with two bearing areas. These unequal and asymmetrical bearings result in cooperation with the tendency of the cathode sheets to move only in one direction, in a very cost-saving spatial fixation, surprisingly sufficient in spite of the simplicity, which prevents cathode sheets and anode sheets from touching. In a further development of the invention, it is provided that the position of the bearing areas is altered during the separation process. Hereby, it is advantageously attained that a penetration of the fixation element into the separating layer is not caused. Already, a relatively small change in position is sufficient, particularly when to a fargoing extent punctiform abutting spacers are used, in order even during a longer fixation period, to prevent the occurring of recesses and to avoid penetration of the spacer elements. The time-wise distance of one position change from another may be great.

In a further development of the invention, it is provided that the alteration of the position of the bearing areas occurs according to a previously determined rhythm. Through this measure, the alteration of the position of the bearing points may be adapted particularly favorably to the operational requirements in each case. Especially in this manner, too great time intervals are prevented.

In a further development of the invention, it is provided that the fixation may be discontinued after a predetermined time corresponding to the separation of a previously determined thickness of metal layer. It was found that it is possible after a certain time to discontinue the fixation of the cathode sheets without causing a distortion of the cathode sheets. In this manner, it is advantageously possible to lower the number of fixation apparatus to be introduced in an electrolysis and thus to decrease the investment costs.

In a further development of the invention it is provided that the fixation is terminated on the day after its beginning, advantageously 24 hours after beginning, or after a multiple of 24 hours. It was found completely surprisingly that the cathode sheets already on the day after the starting of electrolysis, particularly after 24 hours of separation time, reveal a stiffness which sufficiently prevents a distortion, although it still moves mechanically and may be buckled. Already after 24 hours, the electrodes stand at normal current intensities, for example at 180–200 $A/m^2$ and normal electrolyte temperature, for example 60° C. sufficiently. Should the operation with lower current intensities or more unfavorable temperatures, mainly a separation time of 2 days is sufficient, in order to attain a sufficient rigidity of the cathode sheets. The daily rhythm is, in this connection, especially advantageous, as therefore the working occurring in connection with the fixation by an especially suitable shift, for example, the morning shift, may be transferred. The discontinuation of the fixation after 24 hours, or upon attaining a corresponding separation thickness, has still the further advantage that therefore an alteration of the position of the fixation points during this short time relative to the length of the anode travel may be eliminated. In toto there results a very simple and practicable method for the electrolytic separation.

In another development of the method, it is provided that the bath surface is covered and the electrolyte temperature is set higher than 60° C. Therefore, it may advantageously be provided that the spatial fixation according to the present invention renders superfluous a continuous supervision of the anodes and cathodes for short circuits.

For carrying out the method of the electrolytic separation of copper, it is provided that at least on one side of the cathode, a fixation apparatus is arranged, which abuts on the cathode surface. Hereby, it is advantageously possible to undertake, according to the present invention, the spatial fixation of the cathode. In this connection, advantageously the natural tendency of the cathode sheets is taken into consideration, on the basis of the same method of production, to be similarly deformed.

In a development of the invention, it is provided that the fixation apparatus is constructed lying on both sides of the cathode. Hereby, also cathodes may be spatially fixed which buckle or are distorted not only uniformly to one side, but also toward the other side. Furthermore, it is hereby prevented that the cathode, as a reaction to a buckling or distortion, may move as a whole to the free side.

In a further development, it is provided that the points on which the fixation apparatus abuts on both cathode surfaces, are arranged differently on both cathode surfaces and, in this connection, are abutting particularly at the lower corners and in the center of the cathode. Hereby, in an advantageous manner, the main tendency for buckling may be pointedly counteracted. The fixation therefore takes place in such a manner that only the areas threatened with buckling are fixed, the intermediate areas, however, just as the upper edge of the cathode which is already sufficiently fixed by means of the lug-type bands and the cathode mounting rods, remain free from fixation.

In a further development of the invention, it is provided that the fixation apparatus has supporting elements between an anode and a cathode. In this manner, particularly advantageously, the anode which both upon refining and upon recovery electrolysis processes, has a stable construction, is taken along for the supporting and fixation of the cathode, so that the fixation apparatus itself may be constructed particularly easily and simply. The fixation apparatus is thereby particularly well manageable and may be moved or removed without problem. Beyond this, upon a dimensioning of the supporting elements in the size of the spacing between the anode and the cathode, the reliability against a contacting of an anode and a cathode may be further increased.

In a further development of the invention, it is provided that the supporting elements, hereinafter called spacers, are advantageously constructed as balls, cylinders or prisms, which together with mounting elements form the fixation apparatus. Balls, cylinders or prisms have a surface form which is relatively nonsensitive to the settling of deposits. Therefore, it is without further ado possible to leave the supporting elements, without cleaning the same, for several days between an anode and a cathode. A bridge formation is advantageously prevented. The balls, cylinders or prisms are held in their vertical position by holding rods or similar elements, so that they are easily and simply brought into the desired positions.

In a further development of the invention, it is provided that the fixation apparatus for several cathodes are combined by means of carrier elements into a manageable unit. With this construction, the introduction, moving and removal of the supporting elements is especially facilitated, as therefore, for a larger number of cathodes of an electrolytic cell, a simultaneous fixation is attained. The moving and conversion of the fixation elements requires only a small expenditure, which lies far below the expenditure which is necessary with non-fixed cathodes for the continuous supervision of temperature and overcoming of disturbance.

In a further development of the invention, it is provided that the supporting elements and their holding elements consist of material which does not conduct electrical current, for example, porcelain or hard rubber, particularly, however, of polyethylene and polypropylene. Furthermore, they are not attacked by the electrolyte liquid and therefore may be used for a long time. The deposit of slurry or sediment is particularly hindered on porcelain and smooth surfaces of synthetic material or plastic. Particularly advantageous is the utilization of polyethylene and polypropylene. Balls, cylinders and prism profiles made of these relatively light materials, $\gamma \approx 1.0$, are readily obtainable in the market. Upon the utilization of these synthetic materials, there results a particularly favorable, easy and durable embodiment for the fixation apparatus with good qualities of use.

In a further development of the invention, it is provided that the supporting elements and their mounting elements of a series of bearing points on consecutively disposed cathodes are confined into a comb like insert apparatus. Therefore, there results an advantageously rigid structure whose fixation elements remain completely free from deposits. The handling of the comb-type introduction apparatus is without problems, it is simply introduced into the intermediate spaces between the anodes and cathodes in each case at previously determined points of the cathodes, for example on the sides and on the centers of the cathodes.

In a further development of the invention, it is provided that the fixation apparatus are constructed applicable to the electrode mounting rods and that they carry on their upper side a heat-damping protective hood, which advantageously leaves free the contact points of the current rails with the anode lugs and the cathode holding rods. Therefore, the handling apparatus may be constructed particularly easily and introduced advantageously. Through the direct support on the cathode mounting rods, special supporting apparatus becomes superfluous, and the total level of the bath increases an in substantial amount. At the same time, a direct support of a heat-damping protective hood on the fixation apparatus is possible. The contact points of the current rails are advantageously not covered, so that they may be further cooled by the factory air. Therefore, with the same heating, the electrolyte temperature is increased and the separation output of the electrolysis process is improved.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 1 illustrates an embodiment of fixation apparatus utilizing balls suspended on cords or thin rods as the spacers;

FIG. 2 illustrates an embodiment of a fixation apparatus in the form of a comb-type handling unit;

FIG. 3 is a schematic and fragmentary view of an electrolysis bath showing only two cast anodes and a cathode sheet therebetween with fixation apparatus constructed in accordance with the present invention;

DESCRIPTION OF THE PREFERRED EMBODIMENTS

Referring to FIG. 1, a holding rod 1 is illustrated for supporting individual spacers 2 by way of strands or thin rods 3. In spite of the simple fastening on the strands or thin rods 3, the spacers 2 remain in their positions between the anode and cathode, as the same do not float in the electrolyte.

Figure 4:
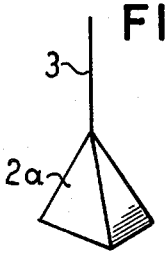
FIG. 4 illustrates a pyramid-shaped spacer.
Figure 5:
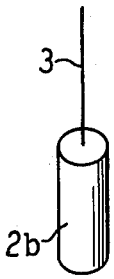
FIG. 5 illustrates a cylindrical spacer.
Figure 6:
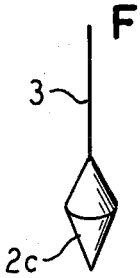
FIG. 6 illustrates a conical spacer.
Figure 7:
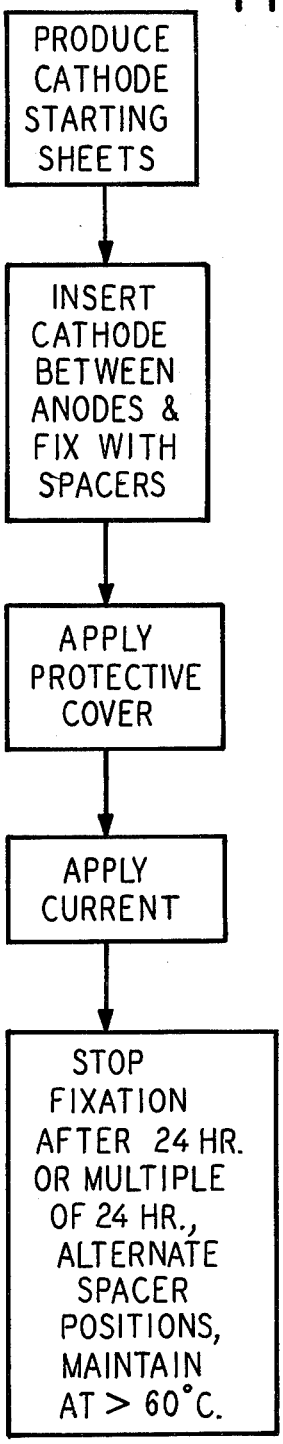
FIG. 7 is a flow chart setting forth the electrolysis processes in accordance with the present invention.

The spacers 2 may have any desired form, for example, a double comb or pyramid, as illustrated in FIGS. 4 and 6. Particularly advantageous are, however, balls or profile sections, which are obtainable without problems or producible for a subsequent equipment, as illustrated in FIGS. 1–3 and 5.

The spacers are shown at *2a,2b* and *2c*, FIGS. 4–6. The length or diameter, respectively, of the spacers 2 is smaller than the theoretical required spacing between an anode and a cathode, advantageously approximately 5 mm smaller. Therefore, the differences in the cathode thicknesses and the like and taken into consideration, so that at any time an easy and free introduction, movement and removal of the spacers 2 is possible. The spacers 2 are advantageously made of homogeneous synthetic material or plastic; they may, however, also have a filler media, for example, quartz sand in order to reduce the cost of production and/or increase their specific weight.

FIG. 2 illustrates a combination of elements 1, 2 and 3 of FIG. 1 into an integral handling unit 4, stable as to form, which has a comb-type shape. The spacers 5 are here preferably no longer spherical, cylindrical or prismatic, but conical with an upward facing taper. The combination of the elements 1, 2 and 3 into a comb-type structure 4 is particularly advantageous for handling, and the construction of the spacers 5 in a conical form is particularly advantageous for the prevention of bridge formations on the spacers. The production of the comb-type structure 4 may take place by means of a simple adhesion of corresponding individual parts, for example plate sections, likewise, also a production by means of casting is possible, among others.

The total length of the comb-like structure 4 amounts advantageously to not more than 4 m, as longer apparatus are too unmanageable.

FIG. 3 illustrates two anodes 12 and 13 and a cathode sheet 8 arranged between the anodes 12 and 13, the cathode sheet 8 being spaced from the anodes by spacers 6 and 7 which are unequally arranged on the two sides of the cathode sheet, once in the center and twice on the lower edge. The spacers are held by strands or thin rods 15 and 16. At the upper edge, the cathode sheet is held by the lug-type bands 9, which are threaded over the cathode support rod 10. The cathode rod 10 is disposed to contact a current rail 18, while the anode includes lugs 11 for contacting a current rail 17, on each side of an electrolytic bath, only one set of rails being illustrated in FIG. 3. The cathode carrying rods 10 support a frame 14 which may be constructed from a plurality of the elements 1, 2 and 3 of FIG. 1, or may take the form illustrated in FIG. 2. The frame 14 may comprise any desired material, which does not conduct electrical current, for example polyvinylchloride. On the frame 14 is a heat-damping protective hood 21 which covers the upper edges of the bath tank 19 which contains the electrolyte 20. The protective hood 21 includes cut outs 22 at the locations at which the cathode and anodes contact the current rails. The hood 21 may be a fiber mat, as well as a foam mat. It is important that the underside is impermeable to air and that the heat damping is so great that no $H_2O$ condenses on the under side.

The method of the present invention for an electrolytic separation of metals proceeds as follows.

First, cathode starting sheets are produced. The starting sheets may occur through electrolytic separation of a layer on a sheet, from which the separated layer is drawn off after the separation, or for example, by means of cutting to size of rolled thin copper sheets. The cathode starting sheets are inserted in the usual manner in the electrolyte 20 with the anodes and, subsequently, the fixation apparatus is introduced. Next follows a covering of the bath. Upon the subsequent normal separation operation, through the application of current, a movement of the spacers does not need to take place. At the latest, after 2–3 days, mainly, however, already after 24 hours, the cathod has attained a rigidity which prevents a further distortion of the cathode. The fixation apparatus is now removed and the separation process proceeds without such structure, free from disturbance, until the desired final cathode thickness is attained.

In the case of tests, in which cast anodes of 40 mm thickness and starting cathodes with a thickness of approximately 0.5 mm in a refinement electrolysis (electrolyte temperature 60° C., spacing anodes—cathodes 30 mm, cathode size 1 $m^2$, 190 $A/m^2$), were used, the current output of previously 94% could be increased to 97%. In this connection, therefore, the application of thermo color dyes to the cathode holding rods and a continuous supervision could be omitted, and only every 24 hours a control of the cathode holding rod temperatures undertaken by means of a contact surface measuring device. Outside of the increase in the current output to 97% there occurred a decrease in the anode residual portion by 9 kg, with an original anode weight of 330 Kg.

In toto, there results, through the method of the present invention, and under utilization of the apparatus according to the present invention, an increase in the volume-time output, an increase in the current output and a decrease in the occurrence of residue in with improved cathode quality. Furthermore, there results a diminished expenditure of work through the elimination of the continuous disturbance of the installation, as well as a saving in the thermo-color dye. Furthermore, a covering may advantageously be undertaken, the heating vapor saved and a better factory climate results.

As mentioned above, during the electrolysis, the spacers may be positioned in accordance with a predetermined time and location schedule so as to prevent the formation of detents.

The method of the present invention and the apparatus of the present invention were developed for copper refinement. The invention is, however, in no manner limited to copper refinement. It may be utilized in any process where metals are electrolytically separated on cathode sheets, for example, with nickel or cobalt electrolysis. Also, upon utilization of inert cathode sheets, there result appreciable advantages, as the expensive titanium or stainless steel cathode sheets are laid more thinly and thus appreciable investment costs may be saved.

Although we have described our invention by reference to particular illustrative embodiments thereof, many changes and modifications of the invention will become apparent to those skilled in the art without departing from the spirit and scope of the invention. We therefore intend to include within the patent warranted hereon all such changes and modifications as may reasonably and properly be included within the scope of our contribution to the art.

We claim:

1. In a method for the electrolytic deposition of copper, in which at the beginning of the electrolytic deposition cathode sheets are inserted in the electrolyte of an electrolytic bath between anode sheets and are supported on respective cathode support rods, the improvement therein comprising the steps of:

fixing individual points of the cathode sheet surfaces by removably inserting punctiform spacing bodies between the cathode sheets and the anode, including spacing bodies unequally distributed on opposite sides of the cathode sheets;

supporting the spacing bodies depending from holding rods; and supporting the holding rods on the cathode support rods.

2. The improved method of claim 1, wherein the step of fixing is further defined as:

asymmetrically distributing the spacing bodies on both sides of the cathode sheets.

3. The improved method of claim 1, further comprising the step of:

repositioning the spacing bodies in accordance with a predetermined rhythm during the deposition process.

4. The improved method of claim 1, comprising the step of:

removing th spacing bodies after approximately 24 hours.

5. The improved method of claim 1, and further comprising the step of:

removing the spacing bodies after a multiple of 24 hours.

6. The improved method of claim 1, comprising the further steps of:

covering the electrolytic bath; and maintaining the electrolyte temperature higher than 60° C.

7. Apparatus for the electrolytic separation of metals in an electrolyte, comprising:

an electrolytic bath including a tank and an electrolyte in said tank;

at least two anodes supported in said bath parallel to each other;

a cathode suspended in said bath between said anodes;

current conductors extending along both sides of said tank;

respective anode and cathode support members for hanging said anode and cathodes from said conductors, and extending generally perpendicular to said conductors;

a heat-insulating protective cover over said tank, said protective cover including openings at locations where said support members contact said conductors for receiving the ends of said support members therethrough;

a plurality of holding elements; and a plurality of movable punctiform spacing bodies between said cathode and anodes, said spacing bodies depending from said holding elements and variably positioned on opposite sides and in proximity to the cathode surfaces.

8. The apparatus of claim 7, wherein said spacing elements are individually located adjacent the lower corners and the center of the cathode.

9. The apparatus of claim 7, wherein said bodies are constructed as prisms.

10. The apparatus of claim 7, wherein said bodies are constructed as spheres.

11. The apparatus of claim 7, each of said holding elements includes a handle.

12. The apparatus of claim 11, wherein said holding element comprises polypropylene.

13. The apparatus of claim 11, wherein said holding element comprises polyethylene.

14. The apparatus of claim 11, wherein each of said holding elements and the respective spacing bodies are connected to form a comb-shaped structure.

* * * * *